US006250019B1

(12) United States Patent
Simons, Jr. et al.

(10) Patent No.: US 6,250,019 B1
(45) Date of Patent: Jun. 26, 2001

(54) FURNITURE ARRANGEMENT CONFIGURED TO SUPPORT OVERHEAD UTILITIES AND LIGHTING

(75) Inventors: George J. Simons, Jr.; Mark A. Buchalter, both of East Grand Rapids; Howard M. Montgomery, Grand Rapids; Yasuyuki Hirai, East Grand Rapids; Gregory M. Tanis, Grand Rapids, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/289,778

(22) Filed: Apr. 9, 1999

(51) Int. Cl.[7] ..... F21S 8/00

(52) U.S. Cl. ..... 52/36.1; 52/28; 52/220.7; 52/239; 362/147

(58) Field of Search ..... 52/28, 36.1, 220.7, 52/239; 362/145, 147

(56) References Cited

U.S. PATENT DOCUMENTS

| | | | | |
|---|---|---|---|---|
| 2,159,296 | | 5/1939 | Sharp . | |
| 3,389,246 | * | 6/1968 | Shemitz | 52/28 X |
| 3,471,629 | * | 10/1969 | O'Leary | 52/220.7 X |
| 4,300,185 | * | 11/1981 | Wakamatsu | 362/147 X |
| 4,748,543 | * | 5/1988 | Swarens | 362/147 |
| 4,920,458 | | 4/1990 | Jones . | |
| 5,331,526 | * | 7/1994 | Girot et al. | 362/147 |
| 5,394,658 | * | 3/1995 | Schreiner et al. | 52/36.1 |
| 5,511,348 | | 4/1996 | Cornell et al. . | |
| 5,743,054 | | 4/1998 | Luchetti et al. . | |
| 5,784,843 | | 7/1998 | Greer et al. . | |
| 5,806,967 | | 9/1998 | Soorus et al. . | |
| 6,112,472 | | 9/2000 | Van Dyk et al. . | |

* cited by examiner

*Primary Examiner*—Beth A. Stephan
*Assistant Examiner*—Kevin D. Wilkens
(74) *Attorney, Agent, or Firm*—Price Heneveld Cooper Dewitt & Litton

(57) ABSTRACT

A furniture arrangement includes an overhead support defining an elongated overhead utility channel, and one or more lamps attached to the overhead support in recesses formed by the utility channel. A dome-shaped reflector or gull-wing-shaped light-distributing member is attached to the overhead support for distributing light from the lamps downwardly into side areas around the overhead support. The light-distributing members are positioned to both distribute light from the lamp and to visually shield contents of the utility channel from people standing around (or above) the side areas. The utility channel forms light-source recesses for receiving the lamps and lamp ballasts, and wireway recesses for receiving lay-in wiring and utilities, which wiring and utilities are guided by the light-distributing members into the wireway recesses. The overhead support can be part of a partition panel or can be supported on an overhead beam(s) forming part of an overhead framework for distributing utilities throughout an office area and for supporting office accessories. A narrower embodiment utilizes a pair of spaced parallel overhead beams, with a trough recessed between and supported by the parallel overhead beams.

22 Claims, 5 Drawing Sheets

FURNITURE ARRANGEMENT CONFIGURED TO SUPPORT OVERHEAD UTILITIES AND LIGHTING

BACKGROUND OF THE PRESENT INVENTION

The present invention relates to furniture having overhead lighting configured to integrally support utilities overhead.

Modern offices often use furniture systems, such as partition systems and wall systems, to subdivide a building space. In such systems, lighting and utilities often compete for space at a top of the partition and wall systems. A reason is because the lighting needs to be supported in a high position to satisfactorily distribute light, while the utilities need to be located in a high position where they can be easily accessed without disrupting papers on a worksurface and without disrupting a workspace. It is desirable to provide a furniture system where the lighting does not need to be removed or disassembled when working on or adding utilities, and where the total amount of time to do the work is minimized. In fact, it would be very desirable to have a lighting system that actually facilitates working on or adding new utilities. Further, it is desirable to provide a system that is visually acceptable and modernistic in appearance, and yet that ergonomically distributes light.

Accordingly, a furniture arrangement solving the aforementioned needs and having the aforementioned advantages is desired.

SUMMARY OF THE INVENTION

In one aspect of the present invention, a furniture arrangement includes an overhead support defining an elongated overhead utility channel and at least one lamp attached to the overhead support. At least one light-distributing member is attached to the overhead support and is disposed to both distribute light from the lamp and to visually shield contents of the utility channel from at least one direction.

In another aspect of the present invention, a furniture arrangement includes an overhead beam dividing a work area into opposing side areas and an elongated overhead support for utilities that is attached to and supported atop the overhead beam. The overhead support for utilities includes a bottom flange and up flanges defining elongated recesses, at least one of the recesses being constructed to receive lay-in wiring. The furniture arrangement further includes at least one lamp attached to the overhead support and positioned in one of the recesses and a light-distributing member also attached to the overhead support. The light-distributing member is disposed to both distribute light from the lamp downwardly toward at least one of the side areas and to visually shield contents of the utility channel from a person viewing the utility channel from a side thereof.

In another aspect of the present invention, a furniture arrangement includes an overhead support defining an elongated overhead utility channel with a raceway therein for receiving wiring and at least one lamp attached to the overhead support. At least one light-distributing member is attached to the overhead support and disposed to distribute light from the at least one lamp. The light-distributing member is curvilinearly shaped and configured to guide wiring toward the raceway during lay-in of the wiring, and further is configured to distribute light generally outwardly and downwardly from the at least one lamp.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figures 1, 2, 3, 4, 5:
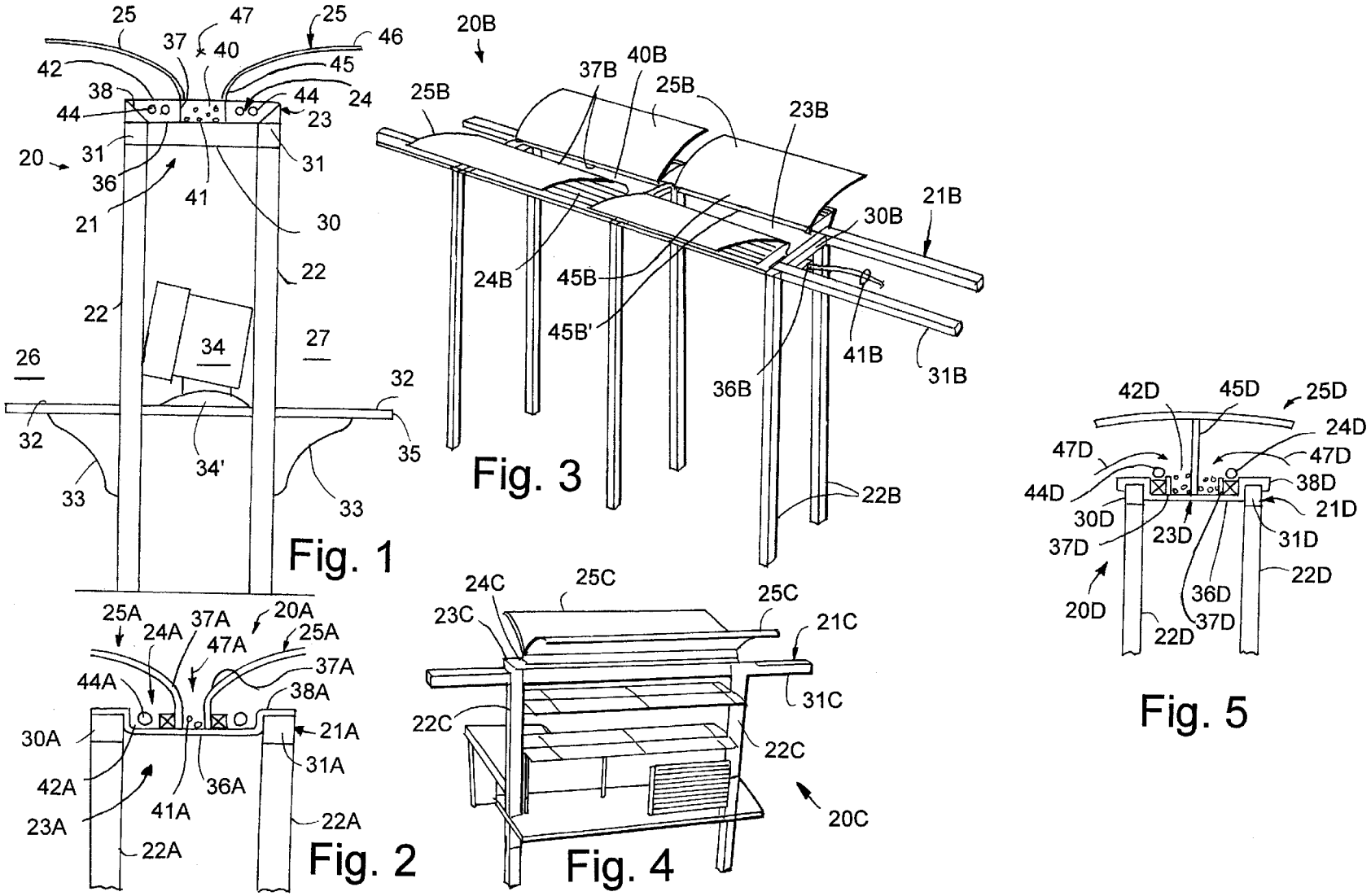
FIG. 1 is an end view of a first fixture arrangement embodying the present invention, including an overhead support defining a utility channel, lighting, and "gull wing" shaped light-distributing members supported on the utility channel, and further including a post-supported overhead framework supporting the overhead support.
FIG. 2 is an end view of a second furniture arrangement similar to FIG. 1, but including an overhead support with its utility channel recessed into a post-supported overhead framework.
FIG. 3 is a perspective view of a third furniture arrangement similar to FIG. 2, but including an overhead support with its utility channel recessed relatively deep into a post-supported overhead framework and with the lighting being located above the overhead framework.
FIG. 4 is a perspective view of a fifth furniture arrangement similar to FIG. 1, but including an overhead support with its utility channel supported on top of a single beam of a post-supported overhead framework.
FIG. 5 is an end view of a fourth furniture arrangement similar to FIG. 2, but including "T" shaped light-distributing members.

A furniture arrangement 20 (FIG. 1) includes an overhead framework 21 of beams supported on posts 22, an overhead support 23 defining utility channels particularly adapted to receive lay-in utilities supported on the overhead framework 21, and a light source system 24 is operably supported in the overhead support 23. Light-distributing members 25 are attached to the overhead support 23 for distributing light from the light source system 24 onto side areas 26 and 27 around the overhead framework 21. The light-distributing members 25 advantageously are spaced apart and create a funnel 47 for directing new utilities into the overhead support 23, and further are shaped to provide a visual shield that substantially prevents people located in (or above) the side areas from seeing the utilities in the overhead support 23, as described below.

The overhead framework 21 and posts 22 are sufficiently described below for a person of ordinary skill to understand the present invention. Nonetheless, a furniture system including the overhead framework 21 and the posts 22 is shown and described in detail in U.S. Pat. No. 5,784,843, issued Jul. 28, 1998, entitled Integrated Prefabricated Furniture System for Fitting-Out Open Plan Building Space and in application Ser. No. 09/153,216, filed Sep. 14, 1998, entitled Integrated Furniture System Including Overhead Framework System and Partition System (now U.S. Pat. No. 6,112,472). The entire contents of both the patent and the application are incorporated herein by reference. Briefly, the overhead framework 21 (FIG. 1) includes pairs of short beams 30 and pairs of long beams 31 attached in a rigid orthogonal arrangement by "L," "T," "X," and "I" connectors (not specifically shown). It is contemplated that the beams 30 and 31 can be hollow tubular beams or have X-shaped or other cross sections. The posts 22 are rigidly connected to support the overhead framework 21 at a height sufficient to allow people to walk under and around the overhead framework 21. Worksurfaces 32 are supported by cantilever brackets 33 attached to the posts 22. The worksurfaces 32 can extend continuously and be one piece, or can be separate worksurfaces with abutting rear sections. As illustrated, a video display terminal 34 is rested on the worksurface 32 under the overhead framework 21 on a turntable 34' that allows a person at either front edge 35 of the worksurface 32 to use the video display terminal 34.

The overhead support 23 (FIG. 1) is U-shaped and faces upwardly. The overhead support 23 is secured to the overhead framework 21, such as by bolting or releasably fastening a bottom flange 36 of the channel 23 to the beams 30 and 31. The overhead support 23 includes a pair of inner up flanges 37 and a pair of angled outer up flanges 38. The area between the inner up flanges 37 forms a central wireway 40 for receiving lay-in wiring 41 or other utilities. The area between the up flanges 37 and 38 on one side forms a recess 42 for receiving the light source system 24. The light source system 24 includes ballasts and a pair of lamps 44.

The light-distributing member 25 (FIG. 1) comprises a curvilinearly bent sheet having a bottom 45 removably secured to a top of the inner up flange 37, and a body 46 that extends upwardly and outwardly from the up flange 37. It is contemplated that a number of different connecting arrangements can be used to connect the bottom 45 to the up flange 37 with sufficient rigidity and structure to securely support the light-distributing member 25 in its cantilevered position over the recesses 40 and 42 of the overhead support 23. For example, parallel flanges can be raised (see FIGS. 6 and 7), or bolts can be used to couple the bottom 45 to a side of the up flange 37. The body 46 has a peculiar concave shape that is reminiscent of a gull-wing-shape and includes a bottom surface having a surface reflectivity and roughness, chosen to reflect light from the lamps 44 onto areas around the furniture arrangement 20 with a desired degree of distribution. The outer up flanges 38 are outwardly angled to allow the light to travel from the lamps 44 upwardly and outwardly into contact with the light-distributing members 25, thus allowing a greater and improved distribution of light. The concave shape of the body 46 further causes an upper surface of the light-distributing members 25 to form a funnel-shaped inlet 47 that naturally directs the wiring 41 along a pathway into the wireway 40. Since the body 46 of light-distributing member 25 extends upwardly and outwardly, and since it is concavely shaped, the light-distributing member 25 acts as a visual shield that prevents people standing at and around the front edge 35 of the worksurface 32 from seeing the wiring 41 and from seeing into the overhead support 23. Notably, mezzanines and raised floors often exist in many modem office areas, and there are often places in the mezzanines and on the raised floor areas where people can look horizontally or somewhat downwardly onto people and work areas therebelow. Thus, the visual shielding by the light-distributing members 25 can be very desirable, since such people cannot see the wiring 41(both due to shadowing as well as visual shielding), nor can such people see into the overhead support 23. Even further, there are known office buildings where glass and open areas are provided, such as in elevators and balconies that open up between floors. By design, people in the elevators or in higher floors can see into lower floors. However, the present light-distributing members 25 are particularly configured to act as visual shields to block even these people from seeing the wiring 41 and from seeing into the overhead support 23.

Additional embodiments of the present invention are shown and described in FIGS. 2–8. In these additional embodiments, similar and identical features are identified with the same number, but with the addition of a letter such as "A," "B," "C," and the like. This is done to reduce redundant discussion and to facilitate an understanding of the present invention. Accordingly, it is to be understood that the relevant features and advantages of the first embodiment are equally applicable to the additional embodiments, even though not specifically mentioned when describing the additional embodiments.

The furniture arrangement 20A (FIG. 2) includes an overhead framework 21A supported on posts 22A, an overhead support 23A (defining utility channels) supported by the overhead framework 21A, and a light source system 24A supported in the overhead support 23A. Light-distributing members 25A are attached to the overhead support 23A for distributing light from the light source system 24A onto side areas around the overhead framework 21A. Like in furniture arrangement 20, the light-distributing members 25A advantageously are spaced apart and create a funnel 47A for directing new utilities into the overhead support 23A, and further are shaped to provide a visual shield that substantially prevents people located in (or above) the side areas from seeing the utilities in the overhead support 23A. However, the bottom 36A of overhead support 23A is configured to fit between the beams 30A and 31A. A pair of L-shaped side support flanges 38A extends from the edges of bottom 36A. The side support flanges 38A rest against the inner sides and top of the beams 31A. This arrangement locates the overhead support 23A in a position where it is partially hidden from the sides by the beams 31A. In the illustrated arrangement, the recess 42A created by the side support flanges 38A and the inner up flanges 37A is smaller than in recess 42 above, and thus only a single lamp 44A is used in each side.

The furniture arrangement 20B (FIG. 3) includes an overhead framework 21B supported on posts 22B, an overhead support 23B supported by the overhead framework 21B, and a light source system 24B supported in the overhead support 23B. Light-distributing members 25B are attached to the overhead support 23B for distributing light from the light source system 24B onto side areas around the overhead framework 21B. This furniture arrangement 20B is much like the furniture arrangement 20, but in this furniture arrangement 20B, the overhead support 23B is recessed much deeper into the overhead framework 21B, such that the bottom 36B is located below a bottom of the beams 30B and 31B. This allows wiring 41B to be routed along the overhead support 23B under the overhead framework 21B without having to go over beams 30B. The light-distributing members 25B are similar to the light-distributing members 25 and 25A. Notably, the bottom edge 45B of the bottom 45B of the light-distributing members 25B can be extended in cantilever inward of the inner up flange 37B. This creates an improved visual shield arrangement. Further, the cantilevered inner bottom edges further help retain the wiring 41B in the wireway 40B.

The furniture arrangement 20C (FIG. 4) includes an overhead framework 21C supported on posts 22C, an overhead support 23C defining utility channels supported by the overhead framework 21C, and a light source system 24C supported in the overhead support 23C. Light-distributing members 25C are attached to the overhead support 23C for distributing light from the light source system 24C onto side areas around the overhead framework 21C. This furniture arrangement 20C is much like the furniture arrangement 20, but in this furniture arrangement 20C, the overhead support 23C is supported on a single beam 31C instead of on a pair of closely spaced parallel beams. Also, there are no transverse short beams. (Notably, it is contemplated that the overhead framework 21C would include perpendicularly connected arrangements of beams, but the support of the overhead support 23C is modified as shown.) The bottom of overhead support 23C is attached atop the beam 31C. Notably, this arrangement creates a utility bulkhead arrangement that allows wiring and utilities to be laid in and routed along the overhead support 23C on the overhead framework 21C without interruption.

The furniture arrangement 20D (FIG. 5) includes an overhead framework 21D supported on posts 22D, an overhead support 23D defining a utility channel removably supported by the overhead framework 21D, and a light source system 24D supported in the overhead support 23D. The furniture arrangement 20D includes a T-shaped light-distributing member 25D that is attached to the overhead support 23D for distributing light from the light source system 24D onto side areas around the overhead framework 21D. Unlike in furniture arrangement 20, the light-distributing member 25D creates a laterally facing side-accessed funnel for directing new utilities along lines 47D into the overhead support 23D. However, like furniture arrangement 20, the light-distributing member 25D is shaped to provide a visual shield that substantially prevents people positioned around (or above) the side areas from seeing the utilities in the overhead support 23D. Also like the furniture arrangement 20A, the bottom 36D of overhead support 23D is configured to fit between the beams 30D and 31D. A pair of L-shaped side support flanges 38D extends from the edges of bottom 36D, with the side support flanges 38D resting against the sides and top of the beams 31D. This arrangement is located in the overhead support 23D in a position where it is partially hidden from the sides by the beams 30D and 31D. In the illustrated arrangement, the recess 42D created by the side support flanges 38D and the inner up flanges 37D is vertically smaller than in recess 42 described above, and thus only a single lamp 44D is used in each side. It is noted that the overhead support 23D defines with the bottom 45D for recesses, two of which are wireways and are located adjacent the bottom 45D, and two outer recesses that receive a ballast and a light source 44D outward of the inner up-flanges 37D.

Specifically in regard to the light-distributing member 25D, it includes an elongated bottom 45D (also called vertical portion) that extends vertically several inches above the overhead support 23D. The body of the light-distributing member 25D is dome shaped and extends outwardly over the overhead support 23D, with its sides drooping outwardly and downwardly well outward of the edges of the overhead support 23D. As can be seen by comparing the shape of the body and the gull-wing-shaped bodies previously discussed, the dome-shaped body is also concavely shaped and faces downwardly. It is contemplated that the specific cross-sectional shape can be altered to optimize light-distribution.

The furniture arrangement 20E (FIG. 6) comprises a freestanding partition 50E having a partition frame 51E and removable covers 52E adapted to cover the partition frame 51E. The partition frame 51E includes a tubular beam-like top frame member 53E that, when connected to other partitions, forms a rigid overhead framework 21E not unlike the overhead frameworks previously described. The freestanding partition 50E is shown and described below sufficiently for a person of ordinary skill to understand the present invention. Nonetheless, an exemplary similar partition frame is fully disclosed in U.S. Pat. No. 5,784,843, issued Jul. 28, 1998, entitled Integrated Prefabricated Furniture System for Fitting-Out Open Plan Building Space and in application Ser. No. 09/153,216, filed Sep. 14, 1998, (now U.S. Pat. No. 6,112,472) entitled Integrated Furniture System Including Overhead Framework System and Partition System. The entire contents of both the patent and the application are incorporated herein by reference.

The overhead support 23E is attached to the beam-like top frame member 53E that forms an overhead framework 21E of interconnected beams, such that it is supported and a light source system 24E is supported in the overhead support 23E. A T-shaped light-distributing member 25E (see solid lines) is attached to the overhead support 23E for distributing light from the light source system 24E onto side areas around the overhead framework 21E. Specifically, the light-distributing member 25E includes an elongated bottom 45E that extends several inches above the overhead support 23E. A pair of up-flanges 48E form a connector (called a "post connector" herein) for receiving the elongated bottom portion of the bottom 45E for holding the light-distributing member 25E in an upright position. The body 46E of the light-distributing member 25E is dome shaped and extends over the overhead support 23E with its sides drooping outwardly and downwardly well outward of the edges of the overhead support 23E. Like in furniture arrangement 20D, the light-distributing member 25E creates a laterally open side-accessible opening 47E for receiving wiring 41E being laid into the wireway 40E. Notably, the size of the overhead support 23E greatly affects the placement of the light source system 24E. The light-distribution member 25E extends to provide a visual shield that substantially prevents people located around (or above) the side areas from seeing the utilities in the overhead support 23E.

Figure 6:
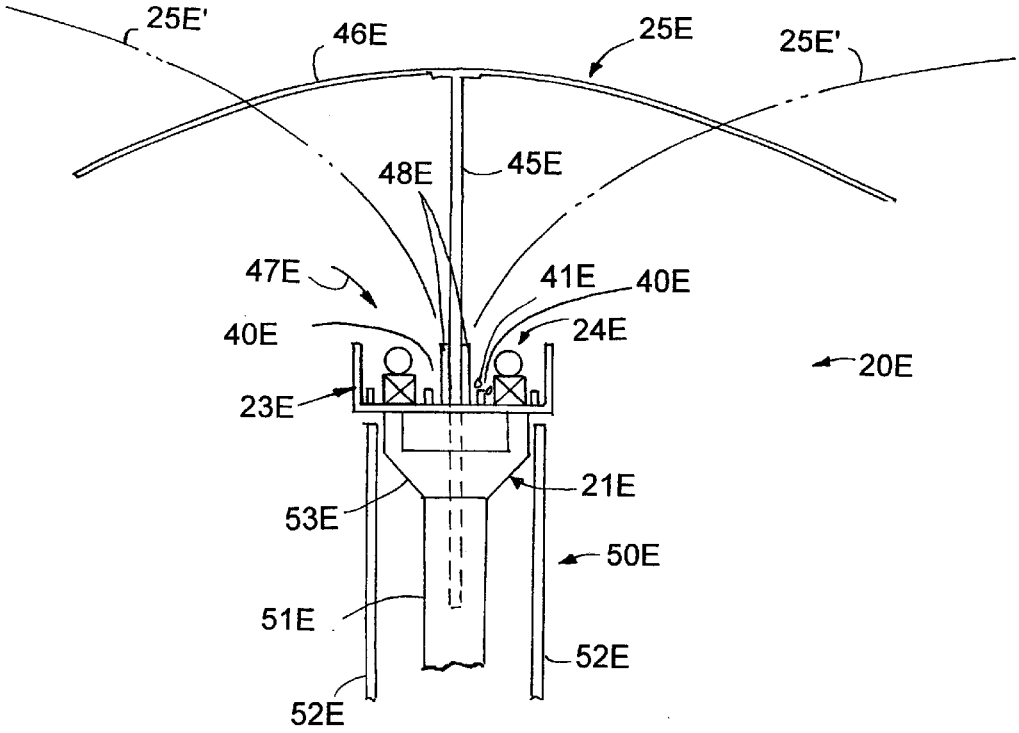
FIG. 6 is an end view of a sixth furniture arrangement, including a partition having a top frame member supporting an overhead support defining a utility channel similar to FIG. 4, but having a T-shaped light-distributing member similar to FIG. 5 shown in solid lines and gull-wing-shaped light-distributing members shown in phantom lines similar to FIG. 1.
Figure 7:
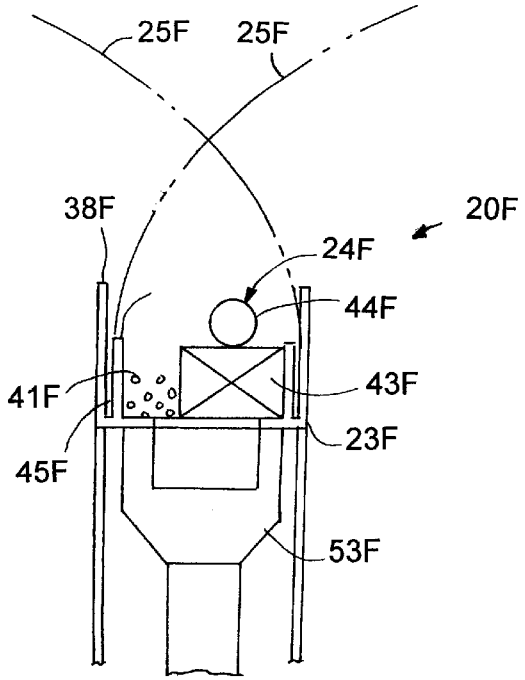
FIG. 7 is an end view of a seventh furniture arrangement, including a partition supporting a support channel defining a utility channel and having a one-sided gull-wing-shaped light-distributing member extended over the utility channel.
Figure 8:
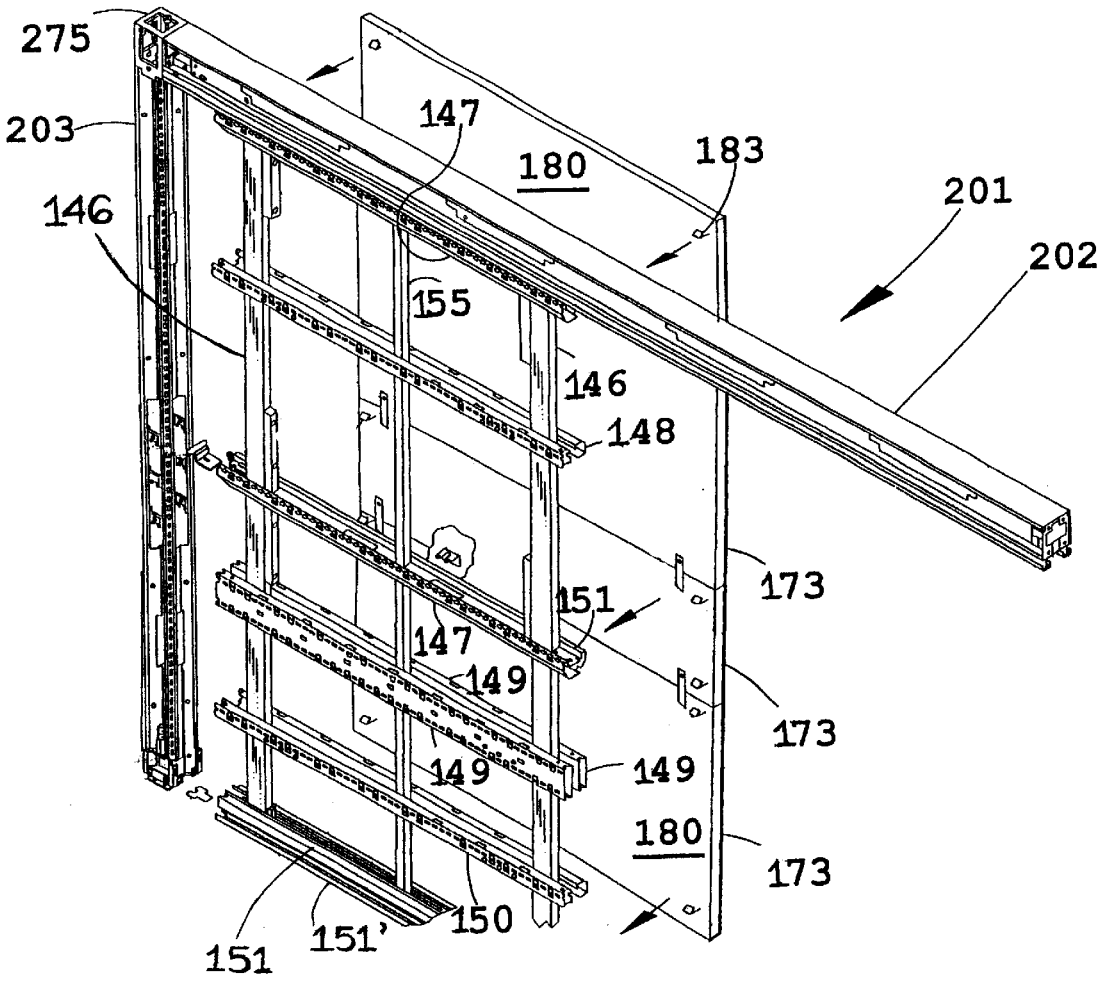
FIG. 8 is a partially exploded perspective view of the overhead framework shown in FIGS. 1–5 and of the partition shown in FIGS. 6–7, the partition being under the overhead framework and forming part of an office, a cover of the partition being exploded away to better show the partition frame.
Figure 9:
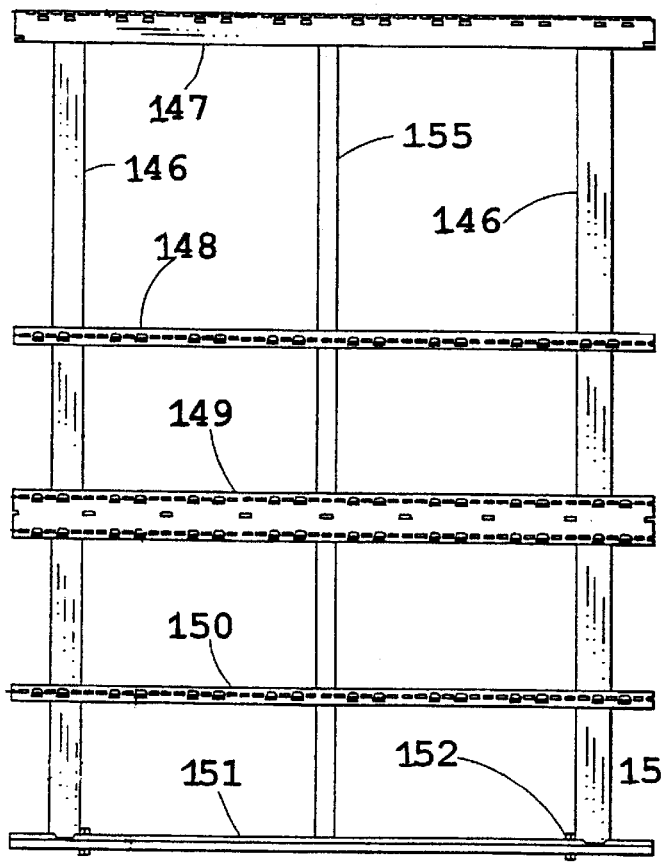
FIGS. 9–10 are side and end views of the partition frame shown in FIG. 8.

A pair of light-distributing members 25E having gull-wing-shaped bodies 25E' are shown in phantom lines in FIG. 6. These bodies 25E' were previously shown and need not be discussed again. It should be clearly understood that either type of light-distributing member 25E or 25E' can be used on the partition 50E.

The furniture arrangement 20F (FIG. 7) is similar to the furniture arrangement 20E (FIG. 6), except that in the furniture arrangement 20F (FIG. 7), the overhead support 23F has a width substantially equal to a width of the top horizontal frame member 53F. Overhead support 23F includes an up flange 37F on each side and a closely positioned outer up flange 38F. A single light-distributing member 25F includes a bottom 45F that fits snugly between the flanges 37F and 38F on one side. Alternatively, the light-distributing member 25F is attached to one of the up flanges 37F and extends upwardly over the overhead support 23F and outwardly over the "open" side of the overhead support 23F. A light source system 24F comprising a lamp 44F and ballast 43F are positioned in the overhead support 23F, and a relatively small but highly useable wireway 41F is located adjacent the light source system 24F inside the overhead support 23F.

Figure 12:
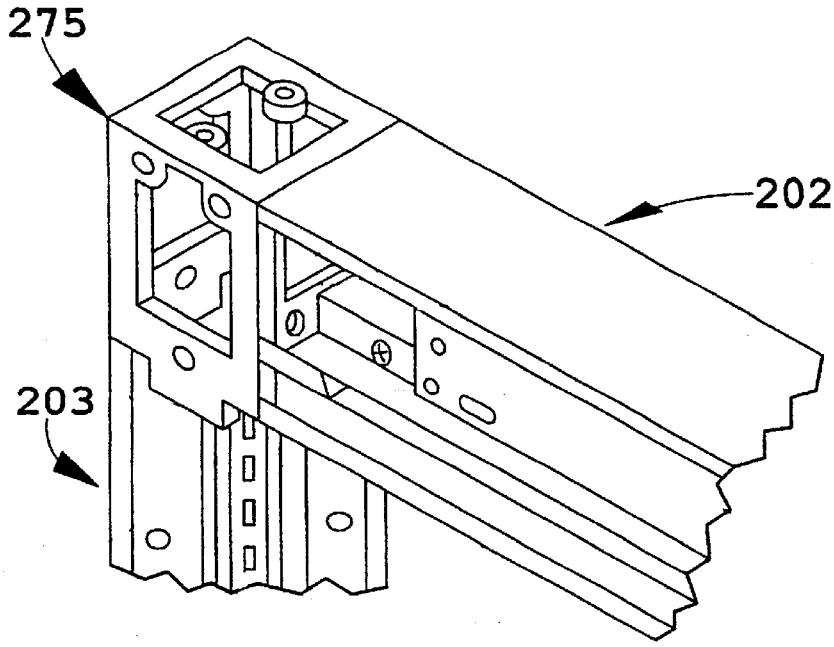
FIG. 12 is a fragmentary perspective view of a corner of the overhead framework including a top section of the floor-engaging post supporting the overhead framework.
Figure 13:
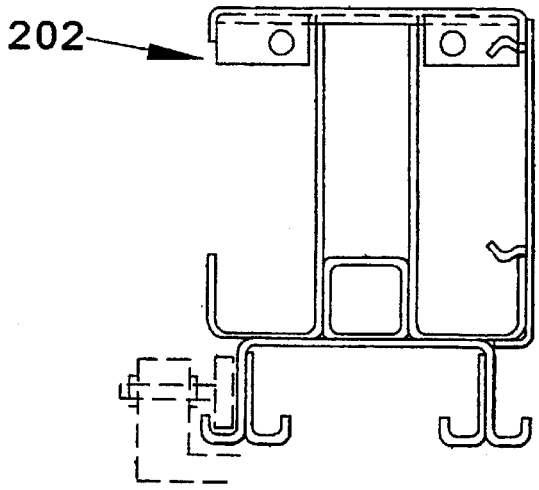
FIG. 13 is a cross section view of one of the beams of the overhead framework.

The overhead framework 21 and posts 22 (FIG. 1), and the partition 50E including its frame 51E and removable covers 52E (FIG. 5) are more clearly described below. For convenience, the overhead framework 21 and posts 22, and the partition 50E with its frame 51E and removable covers 52E will be referred to as overhead framework 201 with beams 202 and posts 203 (see FIGS. 8 and 12–13), and as partition system 141 with partition frame 144 and covers 173 (see FIGS. 8–11).

Figure 10:
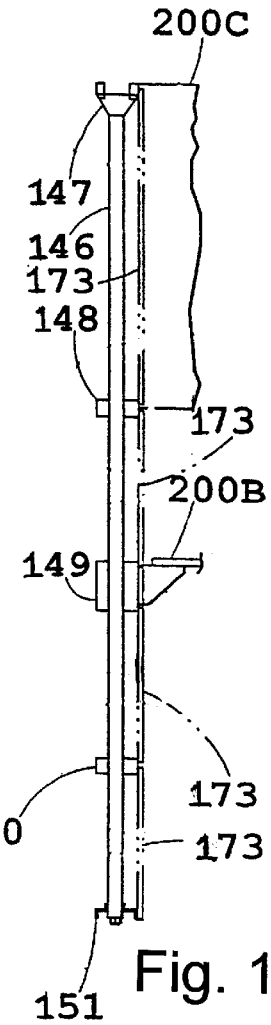
Figure 11:
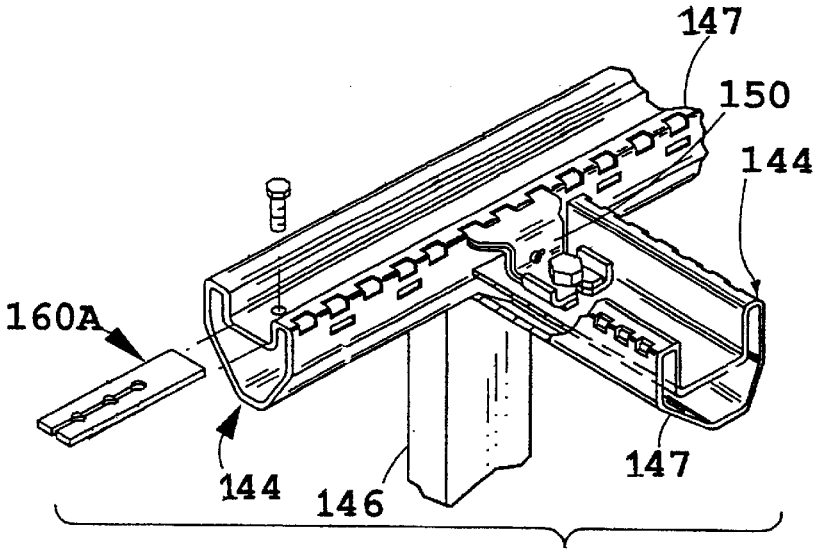
FIG. 11 is a fragmentary perspective view showing items attached to the partition frame.

The partition frame 144 (FIGS. 8–11) includes uprights 146 and 155 interconnected by horizontal frame members 147–151 and floor channel 151'. Covers 173 are attached to sides of the frame 144 to aesthetically cover the same. As shown in FIG. 10, binder bins 200C, worksurfaces or shelves 200B and the like can be supported on the frames 144. In particular, the top horizontal frame member 147 is constructed to support weight and for interconnection, such as by in-line connector bracket 160A and off-module side-connection bracket 150A (FIG. 11).

The overhead framework 201 (FIGS. 8 and 12–13) includes corner connectors 275 (FIG. 12) constructed to rigidly interconnect one or more beams 202 with posts 203. The posts 203 are adapted to stably engage a floor surface and support a matrix of interconnected beams 202. The corner connectors 275 are constructed to interconnected beams 202 in orthogonal arrangements. Advantageously, the partitions 141 can be arranged in office-defining arrangements, with the overhead framework 201 providing utilities and supporting overhead lighting and the like.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A furniture arrangement comprising:

an overhead framework of interconnected horizontal beams, including an overhead support defining an elongated overhead utility channel, the overhead support including a first overhead beam forming part of the overhead framework;

at least one lamp attached to the overhead support; and at least one light-distributing member attached to the overhead support and disposed to both distribute light from said lamp and to visually shield contents of the utility channel from at least one direction.

2. The furniture arrangement defined in claim 1, wherein the at least one light-distributing member is removable.

3. The furniture arrangement defined in claim 1, wherein the interconnected horizontal beams include a second overhead beam that is spaced from and extends parallel the first overhead beam.

4. The furniture arrangement defined in claim 3, wherein the overhead utility channel includes a trough having side sections supported by the first and second overhead beams.

5. The furniture arrangement defined in claim 1, wherein the overhead support defines opposing side areas, and wherein the at least one light-distributing member includes opposing sections each configured to distribute light onto an associated one of said side areas, each opposing section being configured to visually shield contents of the utility channel from persons standing in the associated one of said side areas.

6. The furniture arrangement defined in claim 5, wherein the at least one lamp includes first and second lamps associated with one of the opposing sections for lighting an associated one of the side areas, and wherein the overhead utility channel includes up flanges forming recesses receiving the first and second lamps, the recesses facing upwardly so that light from the first and second lamps is emitted upwardly toward the opposing sections, where the light is then reflected downwardly.

7. The furniture arrangement defined in claim 5, wherein the opposing sections have first and second reflective surfaces facing concavely downwardly for reflecting light from the at least one lamp to the respective side areas.

8. The furniture arrangement defined in claim 7, wherein the opposing sections are separate components, and wherein the first and second reflective surfaces sweep upwardly and outwardly from the overhead support to define a gull-wing shape.

9. The furniture arrangement defined in claim 1, including a vertical portion of the light-distributing member that structurally engages the overhead support to structurally support the light-distributing member on the overhead support.

10. The furniture arrangement defined in claim 9, including a post connector that is elongated and that extends vertically and that is adapted to matably receive the vertical portion on the light-distributing member.

11. The furniture arrangement defined in claim 9, wherein the overhead support includes up flanges that define the overhead utility channel.

12. The furniture arrangement defined in claim 1, wherein the overhead utility channel includes a first recess forming a first raceway for first utilities, and a second recess separated from the first recess and forming a first space to receive the at least one lamp.

13. The furniture arrangement defined in claim 12, wherein the overhead utility channel includes a third recess forming a second raceway for second utilities separated from the first raceway.

14. The furniture arrangement defined in claim 13, wherein the at least one lamp includes a first lam and a second lamp, the first lamp being in the first space, and wherein the overhead utility channel includes a fourth recess forming a second space to receive the second lamp.

15. A furniture arrangement comprising:

an overhead support defining an elongated overhead utility channel;

at least one lamp attached to the overhead support; and at least one light-distributing member attached to the overhead support and disposed to both distribute light from said lamp and to visually shield contents of the utility channel from at least one direction;

wherein the overhead support defines opposing side areas, and wherein the at least one light-distributing member includes opposing sections each configured to distribute light onto an associated one of said side areas, each opposing section being configured to visually shield contents of the utility channel from persons standing in the associated one of said side areas;

wherein the opposing sections have first and second reflective surfaces facing concavely downwardly for reflecting light from the at least one lamp to the respective side areas; and wherein the opposing sections are opposing halves of the same component, and wherein the first and second reflective surfaces sweep outwardly and downwardly from a center of the overhead support to define a dome shape.

16. A furniture arrangement comprising:

an overhead support defining an elongated overhead utility channel;

at least one lamp attached to the overhead support; and at least one light-distributing member attached to the overhead support and disposed to both distribute light from said lamp and to visually shield contents of the utility channel from at least one direction; and a vertical portion extending from the light-distributing member;

the overhead support including opposing flanges that engage opposing faces of the vertical portion to structurally stably connect the at least one light-distributing member to the overhead support.

17. A furniture arrangement comprising:

an overhead support defining an elongated overhead utility channel;

at least one lamp attached to the overhead support; and at least one light-distributing member attached to the overhead support and disposed to both distribute light from said lamp and to visually shield contents of the utility channel from at least one direction;

wherein the overhead support defines opposing side areas, and wherein the at least one light-distributing member include sections each configured to distribute light onto an associated one of said side areas, each opposing section being configured to visually shield contents of the utility channel from persons standing in the associated one of said side areas;

wherein the at least one lamp includes first and second lamps associated with one of the opposing sections for lighting an associated one of the side areas, and wherein the overhead utility channel includes up flanges forming recesses receiving the first and second lamps, the recesses facing upwardly so that light from the first and second lamps is emitted upwardly toward the opposing sections, where the light is then reflected downwardly; and wherein the flanges form up recesses and include a bottom flange that extends longitudinally a distance greater than a width between opposing side faces of the overhead support.

18. A furniture arrangement comprising:

an overhead support defining an elongated overhead utility channel;

at least one lamp attached to the overhead support; and at least one light-distributing member attached to the overhead support and disposed to both distribute light from said lamp and to visually shield contents of the utility channel from at least one direction; and wherein the overhead support includes an upwardly open thin recess, and wherein the at least one light-distributing member comprises a sheet having an edge shaped to fit within the thin recess.

19. A furniture arrangement comprising:

an overhead support defining an elongated overhead utility channel;

at least one lamp attached to the overhead support; and at least one light-distributing member attached to the overhead support and disposed to both distribute light from said lamp and to visually shield contents of the utility channel from at least one direction; and wherein the overhead support includes a top horizontal frame member of a partition frame.

20. A furniture arrangement comprising:

an overhead beam dividing a work area into opposing side areas;

an elongated overhead support adapted to receive utilities and that is attached to and supported atop the overhead beam, the overhead support including a bottom flange and up flanges defining elongated recesses, at least one of the recesses being constructed to receive lay-in wiring and a second one of the recesses forming a utility channel;

at least one lamp attached to the overhead support and positioned in one of the recesses; and a light-distributing member attached to the overhead support and disposed to both distribute light from said lamp downwardly toward at least one of the side areas and to visually shield contents of the utility channel from a person viewing the utility channel from a side thereof.

21. A furniture arrangement comprising:

an overhead support defining an elongated overhead utility channel with an elongated narrow raceway therein for receiving wiring;

at least one lamp attached to the overhead support; and at least one light-distributing member attached to the overhead support and disposed to distribute light from said at least one lamp, the light-distributing member being curvilinearly shaped and having an unencumbered surface configured to guide wiring toward the raceway during lay-in of the wiring, and concurrently having a reflective surface configured to distribute the light generally outwardly and downwardly from the at least one lamp.

22. The furniture arrangement defined in claim 21, wherein the at least one light-distributing member includes opposing sheet sections, the opposing sheet sections each having a first surface configured to reflect and distribute light from the at least one lamp downwardly onto areas beside the sheet sections, and each having a second surface opposite the first surface that forms a funnel that directs the wiring toward and into the raceway during lay-in of the wiring.

* * * * *

UNITED STATES PATENT AND TRADEMARK OFFICE

CERTIFICATE OF CORRECTION

PATENT NO. : 6,250,019 B1
DATED : June 26, 2001
INVENTOR(S) : George J. Simons Jr. et al.

It is certified that error appears in the above-identified patent and that said Letters Patent is hereby corrected as shown below:

Column 2,
Line 5, "fixture" should be -- furniture --;

Column 4,
Line 10, "modem" should be -- modern --;

Column 8, claim 14,
Line 54, "lam" should be -- lamp --;

Column 9, claim 17,
Line 41, change "include" to -- includes opposing --.

Signed and Sealed this

Twenty-sixth Day of March, 2002

*Attest:*

*Attesting Officer*

JAMES E. ROGAN
*Director of the United States Patent and Trademark Office*